US006845859B2

(12) United States Patent
Grundl

(10) Patent No.: US 6,845,859 B2
(45) Date of Patent: Jan. 25, 2005

(54) MOBILE FEEDER AND MOUNTING DEVICE

(75) Inventor: Roland Grundl, Heiligenkreuzsteinach (DE)

(73) Assignee: Joseph Voegele AG, Mannheim (DE)

( * ) Notice: Subject to any disclaimer, the term of this patent is extended or adjusted under 35 U.S.C. 154(b) by 0 days.

(21) Appl. No.: 10/676,768

(22) Filed: Oct. 1, 2003

(65) Prior Publication Data

US 2004/0060798 A1 Apr. 1, 2004

Related U.S. Application Data

(62) Division of application No. 10/054,977, filed on Jan. 25, 2002, now Pat. No. 6,725,996.

(30) Foreign Application Priority Data

Jan. 26, 2001 (DE) ..... 201 01 395 U

(51) Int. Cl.[7] ..... B65G 21/10

(52) U.S. Cl. ..... 198/314; 198/302; 198/306; 198/588; 414/351; 414/503

(58) Field of Search ..... 198/300, 302, 198/306, 312, 313, 588, 812, 314; 414/346, 351, 502, 503

(56) References Cited

U.S. PATENT DOCUMENTS 3,769,988 A * 11/1973 Burenga ..... 460/142
5,100,277 A 3/1992 Musil
6,155,175 A * 12/2000 Rude et al. ..... 104/17.1
6,464,426 B1 * 10/2002 Girouard ..... 404/101

OTHER PUBLICATIONS

Blaw–Knox Construction Equipment Corporation 7–page informational brochure, *Blaw–Knox Mobile Conveyor MC–30*, Bulletin SBMC30–10M–4–91, 1991.

* cited by examiner

*Primary Examiner*—Joe Dillon, Jr.
(74) *Attorney, Agent, or Firm*—Patterson, Thuente, Skaar & Christensen, P.A.

(57) ABSTRACT

A mobile feeder has a distributor conveyor band which is adjustable in at least a height direction. The distributor conveyor band is connected to a carrier frame and can be removed with the carrier frame from the mobile feeder. The mobile feeder is equipped with a mounting device for the distributor conveyor band. The mounting device at least temporarily is provided at the mobile feeder, can be set on the ground, and engages the carrier frame from below. Matching connection assemblies releasably connect the carrier frame to the mounting device. Drive assemblies at the mounting device adjust the carrier frame relative to the mobile feeder to a ground contact position of the distributor conveyor band.

4 Claims, 4 Drawing Sheets

MOBILE FEEDER AND MOUNTING DEVICE

RELATED APPLICATION

This application is a Division of application Ser. No. 10/054,977, filed Jan. 25, 2002 now U.S. Pat. No. 6,725,996, which claims priority to German Application No. 201 01 395.9, filed Jan. 26, 2001.

FIELD OF THE INVENTION

The invention relates to a mobile feeder and to a mounting device for a mobile feeder.

BACKGROUND OF THE INVENTION

During the production of e.g. traffic surfaces mobile feeders have been employed for years to assist the pavers. The mobile feeders intermediately store the paving material and feed it into at least one paver, e.g. in order to simplify manipulations during the transfer of the paving material and to allow a continuous operation travel for the paver. Larger types of such mobile feeders are equipped with a distributor conveyor band and are for this reason bulky and heavy. A mobile feeder with its distributor conveyor band hardly can be transported from one construction site to another. For this reason the distributor conveyor band is disassembled upon demand. For the mounting procedure or the disassembly procedure at least one hoisting apparatus is needed which has to be transported to the mobile feeder. Mounting or disassembly of the distributor conveyor band is tedious.

SUMMARY OF THE INVENTION

It is a task of the invention to create a mobile feeder of the kind as mentioned above allowing to at least disassemble the distributor conveyor band without a supplementary hoisting apparatus such that the mobile feeder can be employed in a more universal way and can be transported more easily, and also to create a mounting device allowing at least a simple disassembly of the distributor conveyor band without the need of a hoisting apparatus.

Thanks to the mounting device which is at least temporarily provided at the mobile feeder and thanks to the driving assembly the mobile feeder contains on-board means for the disassembly and the mounting of the distributor conveyor band such that for these manipulations no supplementary hoisting apparatus is needed. This improves the universal applicability of the mobile feeder. Providing at least one hoisting apparatus and its complicated handling are eliminated. Only the carrying frame with its distributor conveyor band need to be prepared for the co-operation with the mounting device. With the connection assemblies at the mounting device located in low positions it then even can be worked from the ground.

Particularly expedient the mounting device at least partially is integrated into the carrying frame of the distributor conveyor band such that it can be used upon demand at any time. The driving assemblies serve to displace the carrying frame during the mounting or the disassembly but can also be used to hold and position the mounted distributor conveyor band at the mobile feeder. For example, the distributor conveyor band can be kept in its working position at an optimum working altitude.

The mounting device is structurally simple, cheap and compact. It allows a comfortable and quick mounting or disassembly of the distributor conveyor band with its carrier frame and allows, thanks to the ground wheels, to move the disassembled distributor conveyor band on the ground. The mounting device can easily be transported to its application sites and allows to carry out the disassembly or the mounting from the ground since its connecting assemblies are set below the carrier frame. Optionally the structurally simple mounting device belongs to the equipment of each of such mobile feeders. The mounting device can be kept at the distributor conveyor band when the distributor conveyor band is removed from the mobile feeder. It is even possible to keep the mounting device at the mobile feeder when the distributor conveyor band is mounted.

In order to use the height adjustment device of the distributor conveyor band for mounting or disassembly the height adjustment device has a displacement stroke allowing to lower the free end of the distributor conveyor band to the ground.

Expediently at least one hydraulic cylinder is used for mounting or disassembly, respectively, which hydraulic cylinder basically is used during operation of the mobile feeder to adjust the distributor conveyor band about the pivot axis. Hence said cylinder, in most cases a pair of cylinders, fulfils a dual function.

Of advantage is a design of the carrier frame like a double triangular structure into which the fastening parts and the connection assemblies are integrated.

To protect the distributor conveyor band during mounting or disassembly and for easy manoeuvring a ground support ought to be provided at the free end of the distributor conveyor band.

The substantially vertical pivot axis provided in the height adjustment device allows a comfortable lateral adjustment of the distributor conveyor band for the operation of the mobile feeder. Such lateral adjustment can be carried out remotely controlled in automatic fashion, provided that a remotely controlled rotational drive is provided adjusting the distributor conveyor band about the vertical pivot axis. For the mounting device of the mobile feeder, which mounting device partially is integrated into the carrier frame, it is expedient to constitute the drive assemblies by lifting cylinders which are connected between the carrier frame and an oblique conveyor of the mobile feeder and which can be released either from the carrier frame or from the oblique conveyor, as soon as the distributor conveyor band is set on the ground. Those lifting cylinders can be controlled either from the mobile feeder or from the ground.

A stable support of the distributor conveyor band can be achieved by a carrier frame having two triangular structures which are interconnected via a cross beam which is rigid under flexion and torsion and at which the height adjustment device is provided. The lower ends of the carrier frame are anchored by suitable swivel connections to the sub-structure of the mobile feeder.

In this case it is expedient to provide ground wheels at the carrier frame which ground wheels project downwardly and allow to manoeuvre the removed distributor conveyor band. Advantageously the ground wheels can be adjusted by at least 360°.

In case that the hydraulic cylinders for swivelling the distributor conveyor band in the holding structure up and down are connected between the holding structure and one end of the distributor conveyor band facing to the mobile feeder, such that the hydraulic cylinders can follow lateral movements of the distributor conveyor band, a remotely controlled rotational drive of random drive principle can be used, e.g. mechanical, electrical, hydraulic, pneumatic or the like, to carry out the lateral swivelling movements of the distributor conveyor band in automatic fashion. The movements of the distributor conveyor band or its carrier frame relative to the sub-structure of the mobile feeder and/or relative to the mounting device, as needed for mounting or disassembly, can be controlled with the height adjustment device of the distributor conveyor band, provided that the carrier frame is connected to the mobile feeder such that it can be swivelled upwardly and downwardly. This results in a very simple design and a comfortable handling of the mounting device. Alternatively or additively it can be expedient to provide at least one hydraulic lifting cylinder at the frame of the mounting device, which hydraulic lifting cylinder can be connected to the carrier frame such that then the hydraulic lifting cylinder, optionally in co-operation with the height adjustment device of the distributor conveyor band, generates the needed movements. To control this hydraulic lifting cylinder, expediently a pair of hydraulic cylinders, the mounting device can be equipped with its own hydraulic supply. In order to keep the structural efforts for the mounting device as low as possible the hydraulic lifting cylinders alternatively can be connected temporarily to the hydraulic system of the mobile feeder and can be controlled from the mobile feeder.

For a correct positioning of the mounting device below the carrier frame and/or for moving the removed distributor conveyor band to or from the mobile feeder the ground wheels expediently can be adjusted by at least 360° about their ground wheel support axes. The distributor conveyor band with the mounting device will be brought for the mounting step to the mobile feeder and can be positioned there precisely and comfortably and with relatively low power efforts. The removed distributor conveyor band, supported on the mounting device even can be moved laterally with respect to the mobile feeder.

The connection assemblies of the carrier frame and also the fastening parts can be released and tightened comfortably and quickly if removable insertion bolts are used.

BRIEF DESCRIPTION OF THE DRAWINGS

Embodiments of the object of the invention will be explained with the help of the drawings, in which.

DETAILED DESCRIPTION OF THE INVENTION

Figure 1:
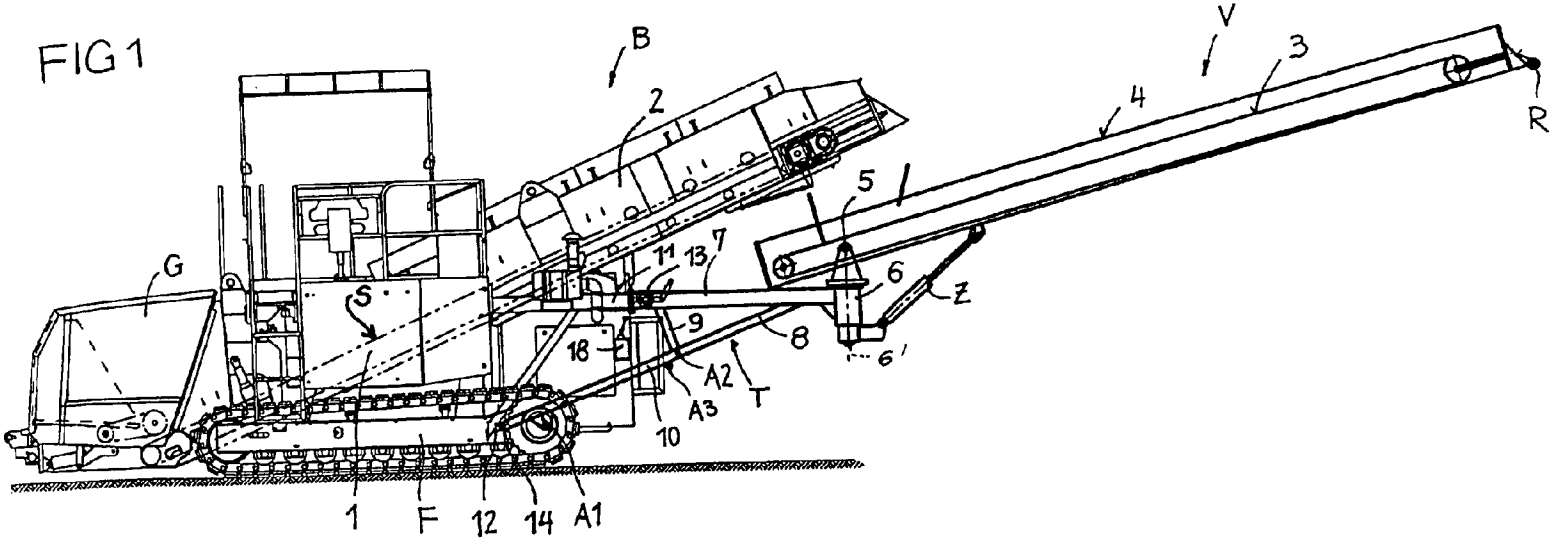
FIG. 1 a side view of a mobile feeder with its distributor conveyor band in working position, FIG. 2 a side view of a mounting device which mounting device at least temporarily can be provided at the mobile feeder for mounting or removing the distributor conveyor band, FIG. 3 the mobile feeder with correctly inserted mounting device in preparation of the disassembly of the distributor conveyor band, FIG. 4 a phase of the disassembly of the distributor conveyor band, FIG. 5 a further phase of the disassembly of the distributor conveyor band, FIG. 6 the mobile feeder, the distributor conveyor band and the mounting device after the completion of the disassembly of the distributor conveyor band, and FIG. 7 a further embodiment of a mobile feeder having a fully integrated mounting device.

A mobile feeder B has in FIG. 1 a sub-structure 1 provided on a wheeled track frame F, a material hopper G at said sub-structure and an integrated material conveyor 2, e.g. an oblique conveyor S. In order to enlarge the reach and also allow feeding of pavers operating at the side of the mobile feeder B or roadsides or roadside slopes and the like additionally a freely ending distributor conveyor band V is provided which is located substantially below the free end of conveyor 2. The free end of the distributor conveyor band can be adjusted in height direction and/or laterally by a height adjustment device.

Distributor conveyor band V has a band 3 received in a housing 4 and is removably mounted via a carrier frame T into the sub-structure 1 of mobile feeder B. A swivel axis 5 is provided at a holding structure 6 between carrier frame T and the distributor conveyor band B. Holding structure 6 can be rotated about a vertical axis 6'. At least one hydraulic cylinder serves to swivel distributor conveyor band V about swivel axis 5 upwardly and downwardly and also to support the distributor conveyor band in the respective position. Swivel axis 5 and hydraulic cylinder Z form the height adjustment device of distributor conveyor band V. The adjustment stroke of said height adjustment device is chosen such that the free end of distributor conveyor band V can be lowered to the ground 20. A ground support, e.g. a roller R, is provided at the free end.

Carrier frame T is designed—in a side view—like a triangular structure having upper struts 7, lower struts 8 and connecting beams 9. The lower struts 8 are prolonged at 10. Upper supports 11 for the upper struts 7 and lower supports 12 for the prolongations 10 are provided at the sub-structure 1 of the mobile feeder B. Connections are established by fastening parts 13, 14, which expediently are joined by removable insertion bolts. At least the fastening parts 14 between the prolongations 10 and supports 12 (at both sides of sub-structure 1) are formed as rotary joints.

Figure 2:
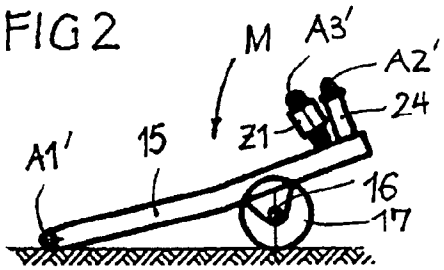

The prolongations 10 and the lower struts 8 have connecting assemblies A1, A2 and optionally A3, respectively, at both sides of the carrier frame T, fitting to matching connections assemblies A1' to A3' of a mounting device M according to FIG. 2.

The distributor conveyor band V can be disassembled together with its carrier frame T from the mobile feeder B. For the disassembly only the fastening parts 13, 14 need to be separated and the hydraulic cylinders Z have to be released from the hydraulic system of the mobile feeder B.

In order to disassemble and remove the distributor conveyor band V with its carrier frame T without employing a hoisting apparatus (a crane or the like) from the mobile feeder B or to mount it there, the mounting device M shown in FIG. 2 at least temporarily is provided at the mobile feeder B.

The mounting device M includes a rigid frame 15 having a vertical wheel adjustment axis 16 and ground wheels 17. The ground wheels 17 can be swivelled about the wheel adjustment axis 16 by at least 360° such that the frame 15 can ride on the ground in FIG. 2 parallel to the drawing plane, perpendicularly to the drawing plane or in random oblique directions. Front side connection assemblies A1' and on supports 24 rear side connection assemblies A2' are provided at frame 15. Said connection assemblies A1', A2' fit to the respective connection assemblies A1, A2 of carrier frame T. The mounting device M is of such low height that it can ride ground born with its connection assemblies A1', A2' below the carrier frame T while the same is mounted to the mobile feeder B.

Furthermore, at least one hydraulic lifting cylinder Z1 can be provided at the frame 15 of mounting device M. Said hydraulic lifting cylinder Z1 has a further connection assembly A3' which fits to the connection assembly A3 at the carrier frame T. Expediently there are two hydraulic lifting cylinders Z1. In a not shown, simplified embodiment of mounting device M the hydraulic lifting cylinder Z1 can be eliminated. The mounting device M may permanently remain at the mobile feeder B. Then, optionally, the ground wheels 17 will be removed.

Referring to FIGS. 3 to 6 now the disassembly of the distributor conveyor band V will be explained.

Figure 3:
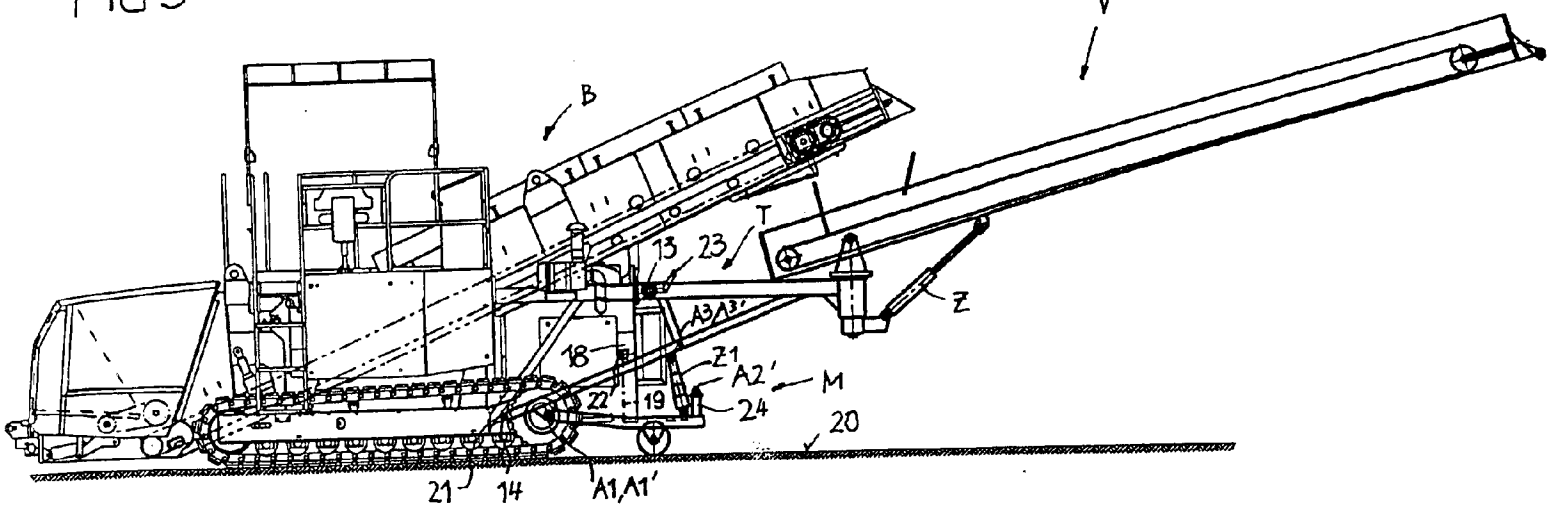

In FIG. 3 the mounting device M is set below the carrier frame T such that the connection assemblies A1' can be connected to the connection assemblies A1, e.g. by insertion bolts 21. Then the hydraulic lifting cylinder Z1 will be connected to the hydraulic system 18 of the mobile feeder B by means of at least one connection line 19 and quick coupler 22. Alternatively, the mounting device M itself can be equipped with its own hydraulic supply system.

Each hydraulic lifting cylinder Z1 is extended until its connection assembly A3' can be connected to the connection assembly A3 at the carrier frame T. The fastening parts 13 and 14 (by their insertion bolts 23) still are in engagement and carry a part of the weight of the distributor conveyor band V with its carrier frame T.

Figure 6:
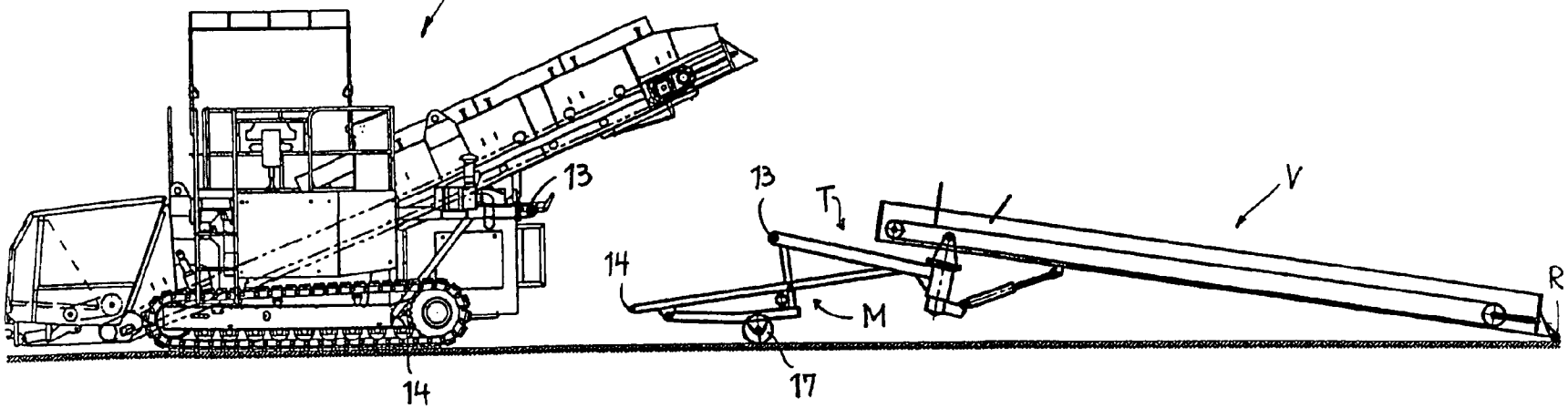
Figure 4:
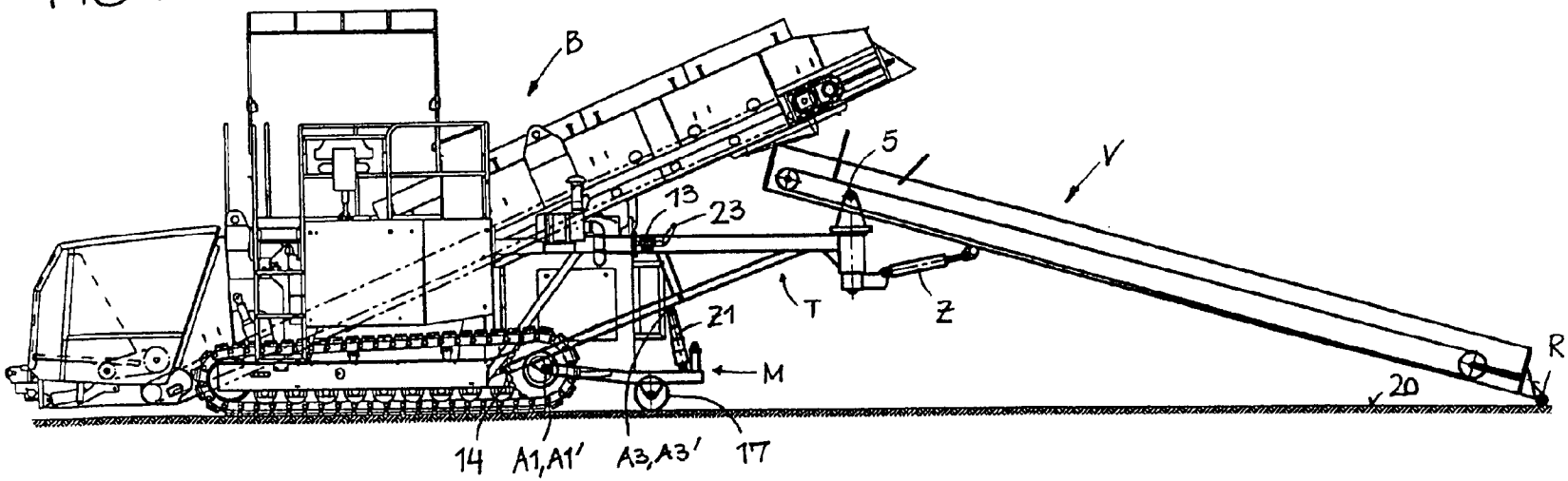
Figure 5:
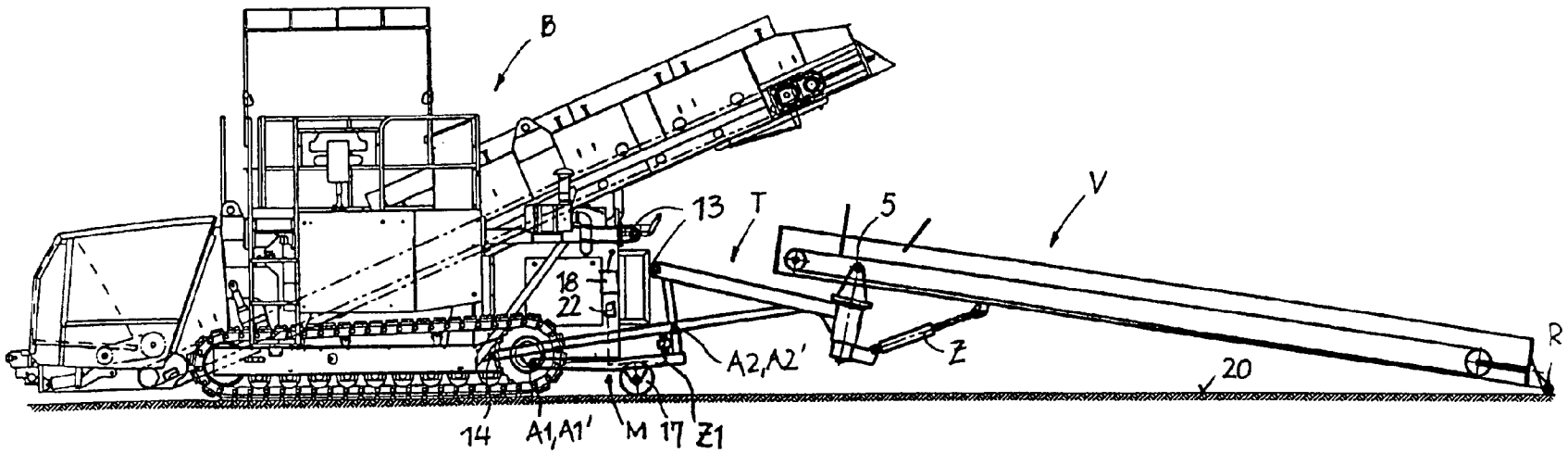

According to FIG. 4 the hydraulic cylinders Z are controlled to tilt the distributor conveyor band V with its ground support R to the ground 20. Then each hydraulic lifting cylinders Z1 is actuated to relieve the carrier frame T at the fastening parts 13. The respective insertion bolts 23 are removed. Subsequently, either with the help of the hydraulic lifting cylinder Z1 alone, or by combined actuation of the hydraulic lifting cylinder Z1 and the hydraulic cylinder Z, the carrier frame T is lowered about the insertion bolts of the fastening parts 14 at the sub-structure 1 of the mobile feeder B, until the connection assemblies A2, A2' meet and can be joined with each other by insertion bolts (FIG. 5). The hydraulic cylinders Z are hydraulically blocked and will be separated from the hydraulic system 18 of the mobile feeder. The hydraulic lifting cylinder Z1 also will be separated by opening the quick coupler 22. Finally, the fastening parts 14 are separated from one another by pulling the insertion bolts. The entire unit consisting of the mounting device M, the carrier frame T and the distributor conveyor band V now is moved away from the mobile feeder B (FIG. 6). Thanks to the swivelable ground wheels 17 the entire unit either can be pulled away in the direction of the drawing plane or can be pushed and/or pulled away laterally.

Instead the carrier frame T can be lowered on the mounting device M by the hydraulic cylinders Z alone, if there is no hydraulic lifting cylinder Z1.

The distributor conveyor band V with its carrier frame T is mounted in reversed sequence at the mobile feeder B.

It is expedient to build the mounting device M from as few single parts as possible and only so high that it can be pushed below the carrier frame T when the carrier frame T is provided at the mobile feeder. Alternatively it is possible to use a higher, U-shaped and wheel equipped frame in the mounting device M in which only the connection assemblies A1', A2' and optionally A3' are positioned so low that they can pushed below the carrier frame while the carriage with its U-leg frame cheeks is positioned sidewardly of the carrier frame T. Such a frame carriage could have several wheel axes and could be designed long enough to support the received distributor conveyor band V.

Figure 7:
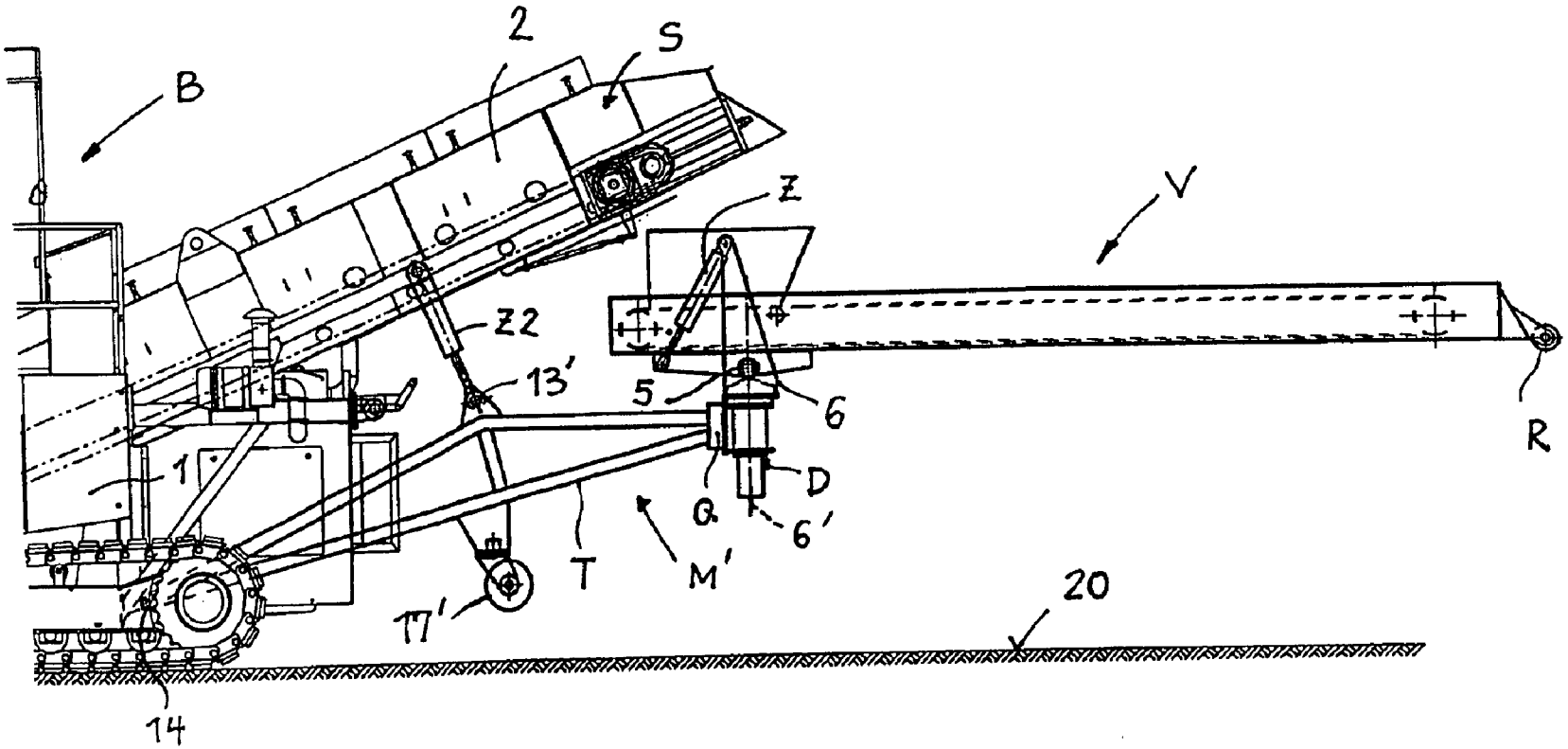

In the embodiment of the mobile feeder B in FIG. 7 mounting device M' is a permanent part of the mobile feeder B. The ground wheels 17' are, preferably, swivelable by at least 360°, provided permanently at the carrier frame T. The carrier frame T e.g. consists of two triangular structures interconnected by a cross beam Q which is rigid against flexion and torsion. The holding structure 6 is mounted to the cross beam Q. A remotely controlled rotary drive D at the holding structure 6 serves rotate the holding structure 6 about the substantially vertical swivel axis 6'. The hydraulic cylinders Z serving to adjust the inclination of the conveyor distributor band and also to tilt the same to the ground (until roller R gets ground contact) are linked to the holding structure 6 and to the end of the distributor conveyor band V which faces the mobile feeder B. Hydraulic lifting cylinders Z2 are linked to both sides of the main conveying system S of the mobile feeder B which conveying system S is constituted by an oblique conveyor 2. Lifting cylinders Z2 are releasably connected to the carrier frame T by fastening parts 13'. Hydraulic lifting cylinders Z2 serve to assist during the mounting or the disassembly and serve also to adjust an optimal position of the distributor conveyor band in relation to the free end of the oblique conveyor 2. Furthermore, at the fastening parts 14 the carrier frame T is swivelably connected to the sub-structure 1 of the mobile feeder B.

To disassemble the distributor conveyor band V first the free end of the distributor conveyor band V is tilted to the ground 20 by means of the hydraulic cylinders Z. Subsequently or at the same time the hydraulic lifting cylinders Z2 are extended until the ground wheels 17' touch the ground 20. At the same time the hydraulic cylinders Z again are retracted accordingly until the carrier frame T is relieved in its fastening parts 14. Then the connections in the fastening parts 14 are released like the hydraulic lifting cylinders Z2 from the fastening parts 13' such that the structural unit of the distributor conveyor band V, the carrier frame T and the mounting device M' at the carrier frame T can manoeuvre on the ground 20. The mounting of the structural unit is carried out in reversed sequence.

What is claimed is:

1. A mobile feeder comprising:

a main conveying system;

a distributor conveyor band coupled to a carrier frame, wherein at least an inclination of said distributor conveyor band relative to a ground surface is adjustable; and a mounting device for removably coupling said distributor conveyor band to said main conveying system together with said carrier frame, wherein said mounting device is partially integrated with said carrier frame, and wherein said mounting device is selectively moveable in relation to said main conveying system into a ground contacting position by at least one drive assembly releasably provided between said carrier frame and said main conveying system.

2. The mobile feeder of claim 1, wherein said at least one drive assembly comprises at least one lifting cylinder coupled at a first end to said main conveying system and releasably coupled at a second end to said carrier frame, and wherein the inclination of said distributor conveyor band is adjustable by a height adjustment device coupled to a main conveying system end of said distributor conveyor band and to said carrier frame.

3. The mobile feeder of claim 2, wherein said carrier frame comprises two triangular structures coupled by a cross beam, and wherein said height adjustment device is coupled to said carrier frame at said cross beam.

4. The mobile feeder of claim 1, wherein said mounting device includes at least one ground wheel projecting downwardly beyond said carrier frame, said at least one ground wheel swivelable about a wheel adjustment axis by at least 360 degrees.

* * * * *